US007001314B1

(12) United States Patent
Hummer, Jr.

(10) Patent No.: US 7,001,314 B1
(45) Date of Patent: Feb. 21, 2006

(54) DUMBBELL SPOTTER

(75) Inventor: Robert G Hummer, Jr., Detroit, MI (US)

(73) Assignee: Dumbell Spotter, LLC, Carmel, IN (US)

( * ) Notice: Subject to any disclaimer, the term of this patent is extended or adjusted under 35 U.S.C. 154(b) by 379 days.

(21) Appl. No.: 10/008,394

(22) Filed: Nov. 7, 2001

(51) Int. Cl.
*A63B 21/072* (2006.01)

(52) U.S. Cl. ..... 482/104; 482/94; 482/108; 482/908

(58) Field of Classification Search ..... 482/17, 482/93, 94, 98, 104, 106, 108, 908, 142, 482/145; D21/686
See application file for complete search history.

(56) References Cited

U.S. PATENT DOCUMENTS

| | | | | |
|---|---|---|---|---|
| 4,249,726 | A | 2/1981 | Faust | |
| 4,666,150 | A | 5/1987 | Segrist et al. | |
| 4,729,561 | A * | 3/1988 | Desjardins | 482/104 |
| 4,773,642 | A * | 9/1988 | Cruz | 482/104 |
| 4,799,672 | A * | 1/1989 | Barrett | 482/104 |
| 4,799,673 | A | 1/1989 | Selle | |
| 4,807,875 | A | 2/1989 | Tanski | |
| 4,815,746 | A | 3/1989 | Ward, Jr. | |
| 4,875,676 | A | 10/1989 | Zimmer | |
| 4,928,961 | A | 5/1990 | Madden | |
| 4,998,723 | A | 3/1991 | Santoro | |
| 5,048,826 | A | 9/1991 | Ryan | |
| 5,108,354 | A | 4/1992 | Becker | |
| 5,190,510 | A | 3/1993 | Goodger | |
| 5,407,403 | A | 4/1995 | Coleman | |
| 5,411,459 | A | 5/1995 | Hayden | |
| 5,472,397 | A | 12/1995 | Ammoscato et al. | |
| 5,616,108 | A * | 4/1997 | Hayden | 482/104 |
| 5,725,460 | A | 3/1998 | Marsh | |
| 5,772,561 | A | 6/1998 | Hayden | |
| 5,823,921 | A | 10/1998 | Dawson | |
| 5,924,964 | A | 7/1999 | Hayden | |
| 5,954,619 | A | 9/1999 | Petrone | |
| 5,971,898 | A | 10/1999 | Schoolfield | |
| 5,989,164 | A | 11/1999 | Kullman et al. | |
| 5,989,166 | A | 11/1999 | Capizzo et al. | |
| D425,152 | S | 5/2000 | Ceppo | |
| D425,950 | S | 5/2000 | Ceppo | |
| 6,086,520 | A | 7/2000 | Rodriquez | |
| D429,295 | S | 8/2000 | Ceppo | |
| 6,149,556 | A | 11/2000 | Jordan | |

(Continued)

FOREIGN PATENT DOCUMENTS

GB 2076299 A * 12/1981

(Continued)

OTHER PUBLICATIONS

Nielsen, Peter, US Appl. No. 09/872,973, filed Jun. 01, 2001, now abandoned, parent application of US Pat. 6,715, 728 B2.*

*Primary Examiner*—Jerome W. Donnelly
*Assistant Examiner*—Victor K. Hwang
(74) *Attorney, Agent, or Firm*—Baker & Daniels LLP

(57) ABSTRACT

A weightlifting apparatus for supporting a dumbbell includes side frames carrying at least one angularly adjustable dumbbell support. In one aspect, the dumbbell support is vertically adjustable on the side frames. In another aspect, the dumbbell support is mounted on a horizontal crossbar extending between and coupled to the elevation adjustable members on the side frames. The elevation adjustment members are motor or manually driven screws. In another aspect, the dumbbell support is movably mounted on the crossbar and latchable in horizontally adjustable positions along the crossbar. In another aspect, a vertically and for/aft adjustable foot rest is disposed within the support frame.

29 Claims, 8 Drawing Sheets

U.S. PATENT DOCUMENTS

D441,813 S 5/2001 Ceppo
6,293,892 B1 * 9/2001 Slawinski et al. ..... 482/104
6,436,016 B1 * 8/2002 Valentino ..... 482/108
6,715,728 B1 * 4/2004 Nielsen ..... 248/339
2003/0134723 A1 * 7/2003 Greenland ..... 482/104

FOREIGN PATENT DOCUMENTS

WO WO 9939778 A1 * 8/1999

* cited by examiner

DUMBBELL SPOTTER

BACKGROUND

The present invention relates, in general, to exercise equipment and, specifically, to weight lifting apparatus and, more specifically, to dumbbells.

Weight lifting using free-weights is widely enjoyable as a form of exercise and strength conditioning. Barbells and dumbbells are used in different workout routines to exercise and strengthen various muscle groups, such as biceps, triceps, pectorals, etc., depending upon the manner in which the free-weights are lifted and for the body position of the user.

In using dumbbells, the dumbbells are typically stored in a rack or on the floor. The user must lift the dumbbells into the starting exercise position for chest or shoulder muscle exercises. These starting exercise position for various muscle groups is well off the ground.

The user must use the strength of his arm muscles, particularly the biceps, in order to move the dumbbells from the floor or rack into the starting exercise position. Such exercises were designed to develop chest and/or shoulder muscles and not arm muscles. Further, particularly at higher weights, it may be difficult for a user to lift heavy weight dumbbells from the floor or rack using only the smaller bicep muscles rather than the larger chest or shoulder muscles. Further, any attempts to lift large weights off of the floor to the starting exercise position could result in a injury to the user's back.

It is known to construct frames specifically designed for receiving a pair of dumbbells, where the frames provide vertical adjustability for the dumbbell rests or supports. However, with one exception, all of the previously devised dumbbell supports are fixedly mounted perpendicular to the frame. This places the dumbbell handles at an inconvenient position for gripping by a weightlifter when in a seated position in front of the dumbbell supports.

In the one instance, a dumbbell holder is provided with a support frame in which the dumbbell rests are fixedly positioned at an acute angle from a horizontal line extending between the rest supports. However, in this design, the dumbbell rests are fixed at the one acute angle.

Further, such dumbbell supports, while providing vertical adjustability, do not have an or have only limited means for horizontal adjustment of the pair of dumbbell rests relative to each other. Thus, dumbbell rests which are fixed at a given spacing on a support frame(s) may not be in an idea position for some weightlifters to easily grasp the dumbbells or, at the competition of the exercise, easily and safely placing the dumbbells back onto the rests.

In one dumbbell support design, the two side frames are connected by a two telescopingly interconnected crossbars. A pin is releasibly extendable through aligned apertures in the ends of the two crossbars to adjust the horizontal spacing between the pair of dumbbell rests. However, one complete side frame, dumbbell rest, and crossbar must be manually lifted or dragged relative to the ground and urged toward or away from the opposed side frame. Due to high weight levels which may be lifted, the support frame, crossbar, and rest represent a considerable weight which presents an inconvenience to the weightlifter in setting up the dumbbell rest support for an exercise. Further, this weight must be supported by the user in order to precisely align two apertures in the crossbars for insertion of the locking pin therethrough.

Thus, it would be desirable to right a dumbbell support which provides easier use of dumbbells in weightlifting exercises. It would also be desirable to provide a dumbbell support which addresses deficiencies found in previously devised dumbbell supports.

SUMMARY OF THE INVENTION

The present invention is a weightlifting apparatus for supporting a dumbbell, or pair of dumbbells. In one aspect, the weightlifting apparatus includes first and second sides frames. Elevation adjustment means are carried on the first and second side frames. A pair of dumbbell supports are respectively coupled to the elevation adjustment means on the first and second side frames for supporting a dumbbell in a plurality of different elevations.

In one aspect, a horizontal crossbar engaged with the elevation adjustment means and carries the dumbbell supports. The dumbbell supports are laterally movably mounted on the crossbar to vary the horizontal spacing between the dumbbell supports.

The dumbbell supports are also pivotally mounted on the elevation adjustment means and/or the crossbar to enable a dumbbell receiver portion of each dumbbell support to be angularly adjusted with respect to the crossbar for ease in grasping and releasing the dumbbells at the beginning and end of certain weightlifting exercises.

The elevation adjustment means, in one aspect, comprises a threaded screw mounted on each side frame. An electric motor is coupled to each screw for simultaneous bi-directional rotation of the screws. Jack nuts carried on opposite ends of the crossbar are elevationally movable along the screws upon rotation of the screws.

In another aspect, the elevation adjustment means also utilizes the threaded screws engaged by nuts carried on opposite ends of the crossbar. However, in this aspect of the invention, the electric motor is replaced by a manually operable crank. Rotation of the crank drives a pulley which is connected by an elongated member, such as a chain or timing belt to toothed pulleys mounted on each threaded screw for simultaneous rotation of each screw in the selected direction upon manual rotation of the crank.

The weightlifting apparatus of the present invention provides significant advantages in weightlifting exercises using dumbbells in that the weightlifting apparatus provides unique pivotally adjustable dumbbell supports to facilitate ease of grasping the dumbbells during certain weightlifting exercises. The weightlifting apparatus also has unique, individually movable, dumbbell supports mounted on a crossbar and latchable in different horizontal spaced positions along the crossbar to accommodate different sized users as well as to facilitate different weightlifting exercises.

The present weightlifting apparatus has automatic elevation adjustment means using a motive power drive source, such as a motor, to allow a varied vertical adjustment of the dumbbell supports for different sized users or for different exercises, such as exercises performed with a weightlifting bench, or a seat, or standing. Manual elevation adjustment of the crossbar is also provided.

The elevation adjustment means of the present invention minimizes the possibility of back injury to a user as well as increasing the user's ability to lift heavier dumbbells since the dumbbells can be easily positioned at the required exercise start height for a particular exercise. This eliminates the need for the user to initially lift the dumbbells off of the floor or from a rack to the required exercise start height using only the small bicep muscles.

BRIEF DESCRIPTION OF THE DRAWINGS

The various features, advantages, and other uses of the present invention have become more apparent by referring to the following details description and drawings in which.

DETAILED DESCRIPTION

Figure 1:
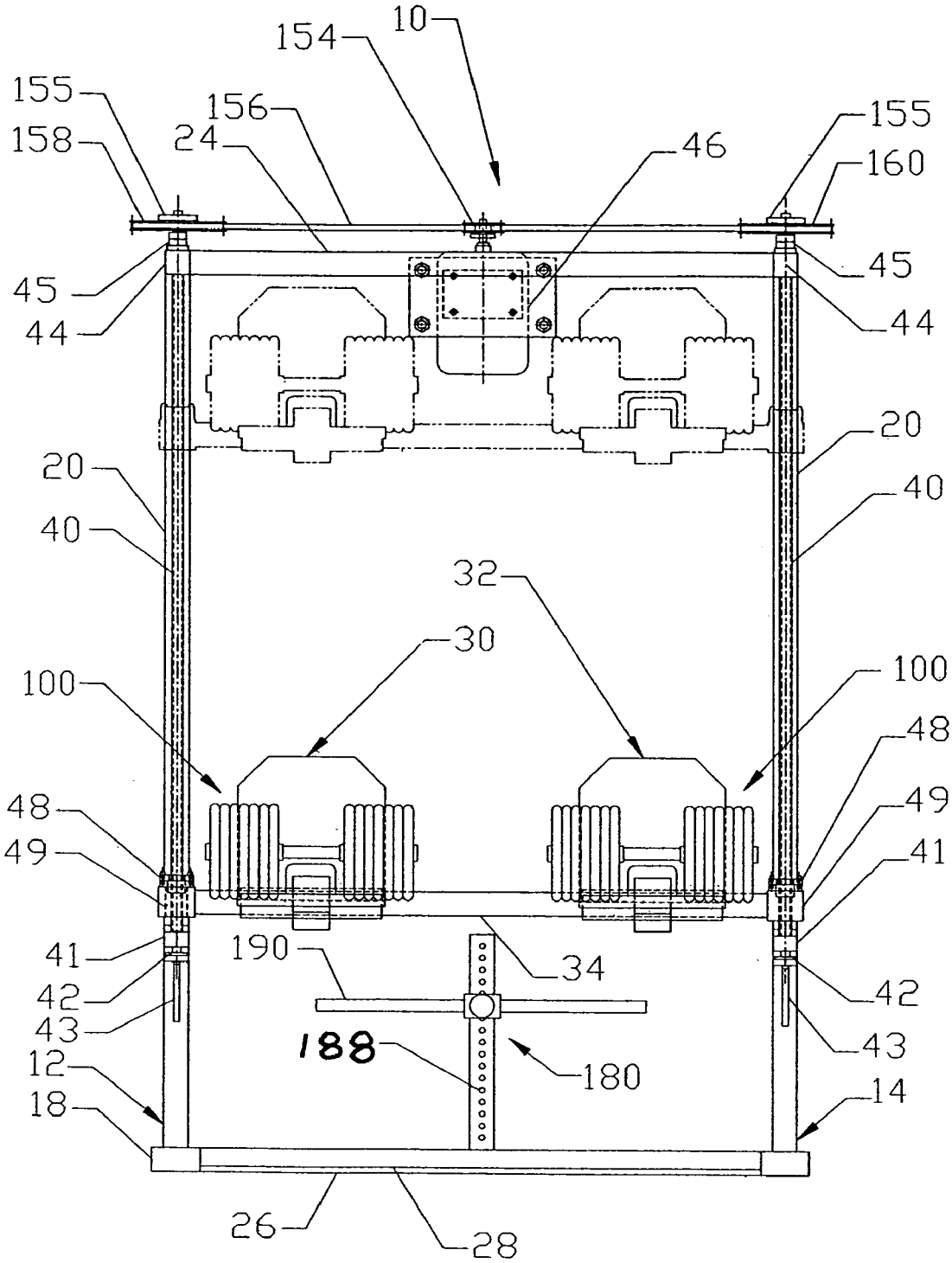
FIG. 1 is a front elevational view of one aspect of a dumbbell support apparatus according to the present invention.
Figure 2:
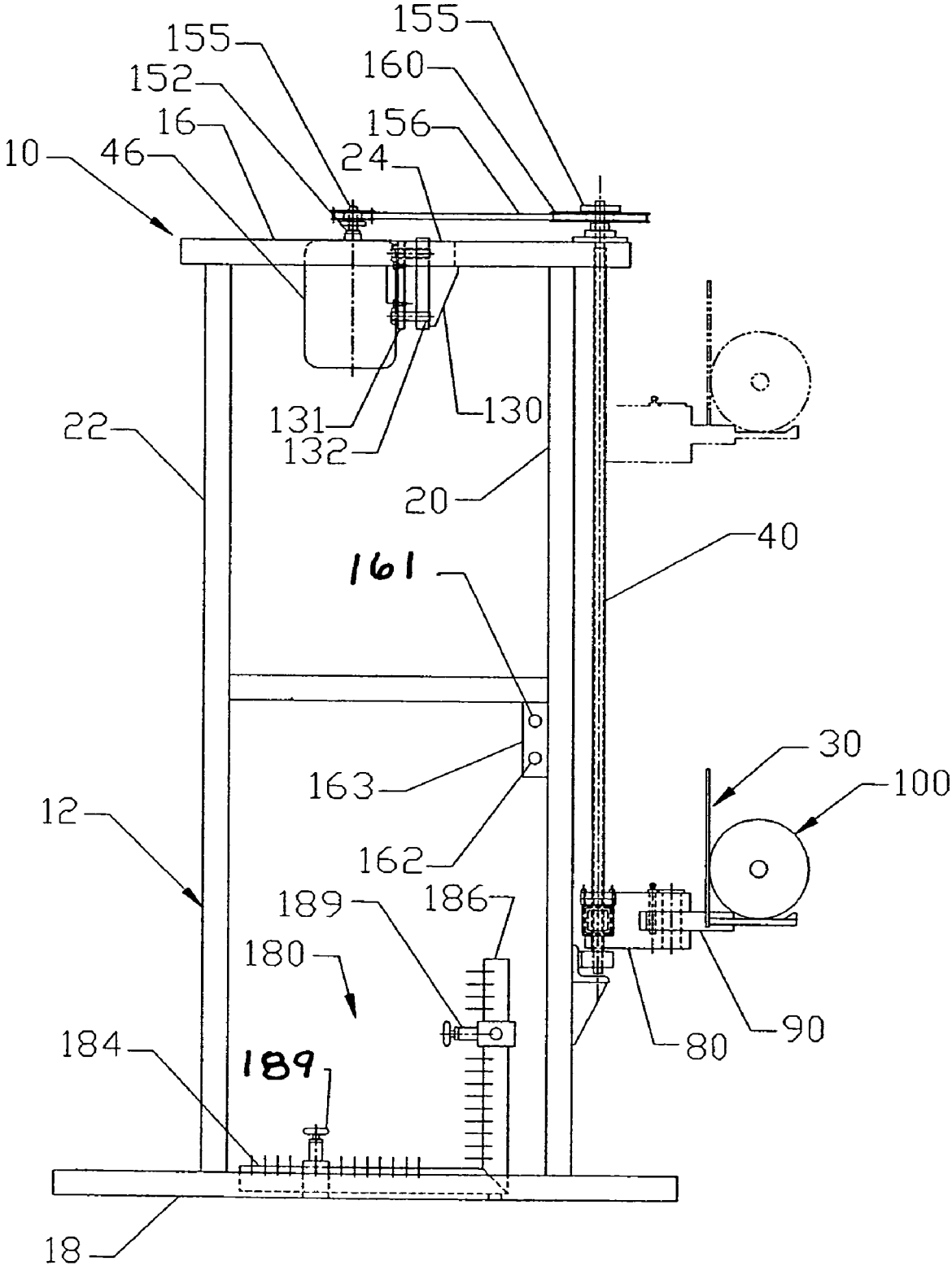
FIG. 2 is a side elevational view of the apparatus that is shown in FIG. 1.
Figure 3:
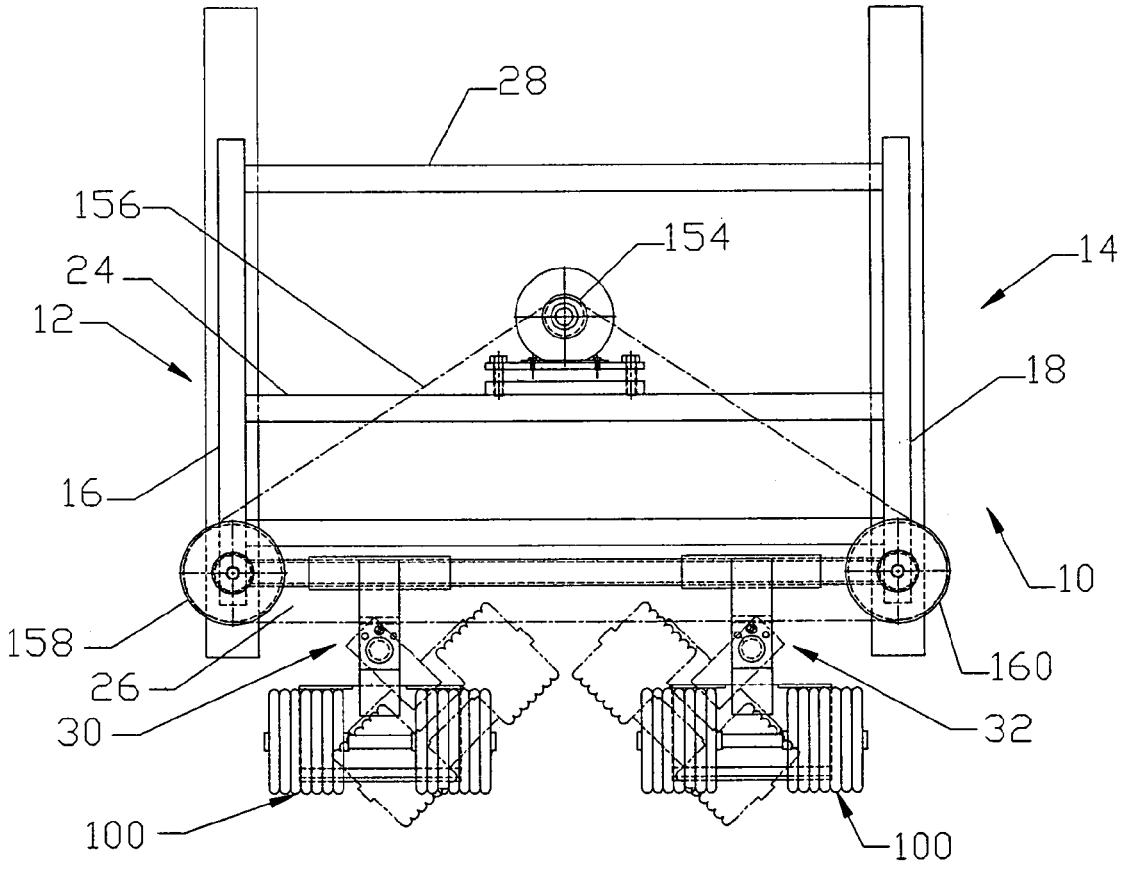
FIG. 3 is a plan view of the apparatus shown in FIG. 1.

Referring now to the drawing, and to FIGS. 1–3 in particular, there is depicted one aspect of a dumbbell support frame 10 according to the present invention. Although the following description of the support frame 10 is described in detail, it will be understood that the specific described construction of the support frame 10 is by example only as the support frame 10 may employ other shapes and interconnected elements.

Thus, by example only, the support frame 10 includes a pair of side frames 12 and 14, each formed of upper and lower transverse legs 16 and 18, respectively, which are interconnected by first, front leg 20 and a second, rear leg 22. The various legs or frame members 16, 18, 20, and 22 may be fixedly joined together into a rigid, unitary structure by any suitable means, such as fasteners in the form of nuts and bolts, or by welds, etc. The pair of side frames 12 and 14 are interconnected, in this aspect, by at least one upper cross leg 24 and at least one, and preferably, two lower cross legs 26 and 28. The upper and lower cross legs 24, 26, and 28 are fixedly joined to and extend between opposed upper legs 16 and lower legs 18, respectively, of the side frames 12 and 14. Further, the upper and lower cross legs 24, 26, and 28 space the side frames 12 and 14 at a preset, fixed distance apart.

A pair of identical dumbbell supports 30 and 32 are mounted on a horizontal crossbar 34. Further details concerning the construction of the dumbbell supports 30 and 32 and the crossbar 34 will be described hereafter in conjunction with FIGS. 4–7.

It will also be understood that the side frames 12 and 14 may be individually deployed without a crossbar so that the dumbbell supports 30 and 32 are mounted, as described hereafter, directly to each side frame 12 and 14, respectively.

As shown in FIGS. 1–3, means are provided for vertically adjusting the height of the crossbar 34 and therefore the dumbbells supports 30 and 32 with respect to the underlying floor surface below the lower legs 18 of the side frames 12 and 14. In this aspect of the invention, the elevating means comprises a elongated threaded screw 40, such as an Acme screw having a high pitch. Such a screw does not rotate after being stopped due to the high thread pitch.

Each screw 40 is rotatably mounted immediately adjacent to the front legs 20 of each side frame 12 and 14. As shown in FIGS. 1 and 2, each screw 40 is mounted in a bearing 41 which seats on a thrust bearing 42 supported by an angle iron gusset 43 fixed to the front leg 20 of either side frame 12 or 14. The top portion of each screw 40 is rotatably supported by a bearing 44 supported by a flange 45 fixed to the front leg 20.

Threaded nuts 48 are fixed on a collar 49 disposed about each screw 40 and fixedly carry the horizontal crossbar 34 therebetween. In this matter, rotation of the screws 40 in one direction by the motor 46 will cause the nuts 48 to traverse each screw 40 in one "up" or "down" direction, depending on the direction of threaded engagement of the nuts 48 with the screws 40 to either elevate or lower the horizontal crossbar 34 relative to the underlying floor surface. This enables the weightlifter to easily adjust the vertical height of the horizontal crossbar 34 by means of a simple pushbutton control as described hereafter.

Rotational control, in this aspect of the invention, is achieved by means of the electric motor 46 having a bi-directional rotatable output shaft 152 extending therefrom. The motor 46 is fixedly mounted to the upper crossbar 24 by means of a flange 130 fixed to and depending from the upper crossbar 24. A plate 131 is fixed to the motor 46 and is dimensionally adjustable with respect to the flange 130 by means of threaded shafts 132 extending between the flange 130 and the plate 131. This dimensional adjustment allows the position of the motor 46 with respect to the front legs 20 of each side frame 12 and 14 to be adjusted to take up any slack in the elongated member or cable extending between the pulley described hereafter.

A first, rotatable member, preferably in the form of a toothed pulley 154, is fixedly mounted on the output shaft 152 by a taper lock bushing 155. A substantially non-extendable connecting member 156 such as a cable or timing belt extends from and rotatably couples the pulley 154 with a pair of spaced rotatable members or pulleys 158 and 160, respectively mounted on the forward ends of the side frames 12 and 14 by taper lock bushings 155. The pulleys 158 and 160 are rotated with rotation of the pulley 154 by the output shaft 152 of the motor 150 in one of two directions thereby rotating the screws 40 in the same direction. "Up" and "down" pushbutton 161 and 162, shown in FIG. 2, are mounted in a control box 163 fixed to one of the side frames 12 or 14, for example. Push buttons 161 and 162 are connected to relays, not shown, mounted in the control box 163 which switch current in opposite directions to the windings of the motor 46 to control the direction of rotation of the output shaft 152 of the motor 46. Continued depression of the respective pushbutton 162 and 161 will enable a weightlifter to position the crossbar 34 at the desired vertical position relative to the floor. The horizontal bar 34 can be easily readjusted in vertical height by merely re-depressing one of the pushbuttons 161 and 162.

The timing belt or cable 156 as well as the pulleys 154, 158 and 160 are preferably toothed enable the cable 156 to rotate the pulleys 154, 158 and 160 in unison in either direction. This insures that both screws 40 rotate in the same direction and in the same angular amount and at the same speed so as to maintain the horizontal crossbar 34 in a horizontal position throughout its entire elevational range of movement shown in FIGS. 1 and 2.

Referring now to FIGS. 4–7, further details of the construction and use of each identical dumbbell rest 30 and 32 will now be described.

Each dumbbell rest 30 and 32, such as the dumbbell rest 30, includes a mounting collar 52. The mounting collar 52 is preferably a tubular member having a hollow bore 54 extending therethrough. The cross sectional shape of the bore 54, as well as, optionally, the cross sectional shape of the outer surface of the mounting collar 52, will be complementary to the shape of the horizontal crossbar 34. Thus, to provide a fixed attitude of the dumbbell rest 30 and 32 relative to the floor, the horizontal crossbar 34 as well as the bore 54 through the mounting collar 52 has a square or rectangular configuration.

Figure 7:
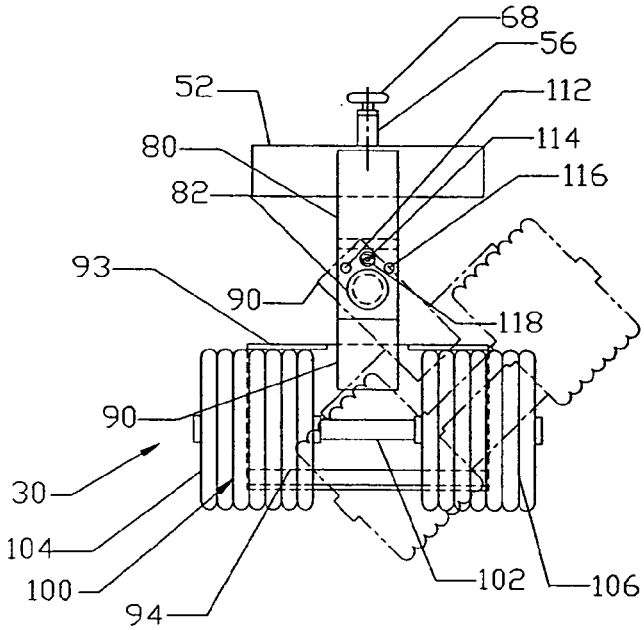
FIG. 7 is a plan view of the dumbbell support shown in FIGS. 5 and 6.
Figure 6:
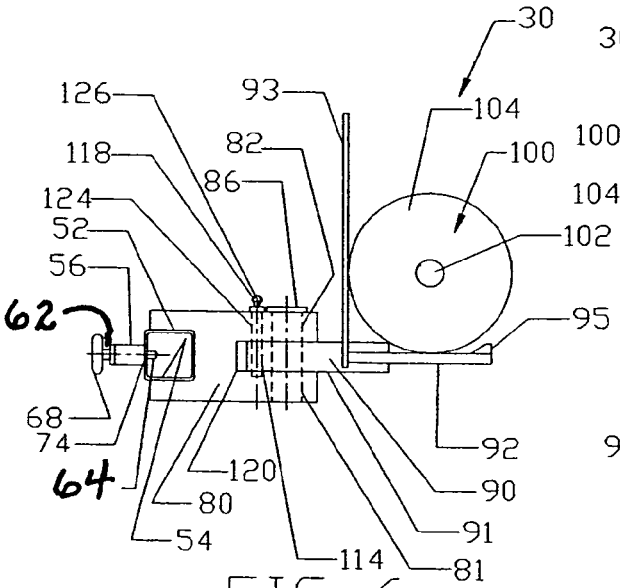
FIG. 6 is an enlarged elevational view of the dumbbell support shown in FIG. 5.
Figure 5:
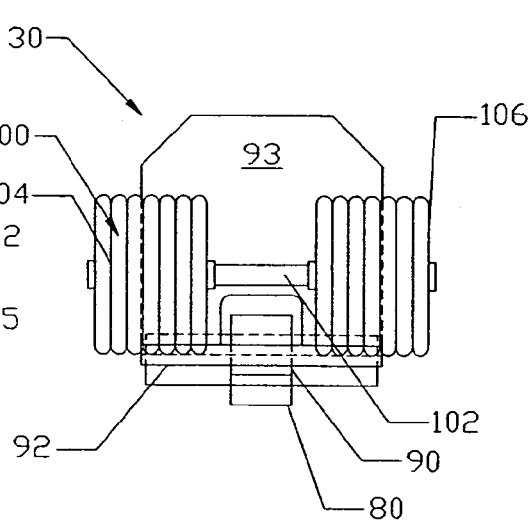
FIG. 5 is an enlarged front elevational view of one of the dumbbell supports shown in FIGS. 1–4.

As shown in FIGS. 6 and 7, a spring loaded plunger 56 is fixed, such as by welding, to one side of the mounting collar 52 and projects away from the collar 52. The plunger 56 has a pin 62. The plunger 56 is moved on a handle, such as a spherical knob 68, to facilitate movement of the pin 62 as described hereafter. A coil spring, not shown, is mounted within the plunger 56 to bias the pin 62 to the latch position shown in FIG. 6.

An aperture 74 is formed in the side of the collar 52 on which the plunger 56 is mounted and receives the end of the pin 62. The pin 62 is biased or urged in a direction to normally position the end 64 the pin 62 through the aperture 74. However, an outward pulling force exerted by the user on the knob 68 will retract the end of the pin 62 from the aperture 74 allowing horizontal adjustment of either dumbbell supports 30 and 32 as described hereafter.

Figure 4:
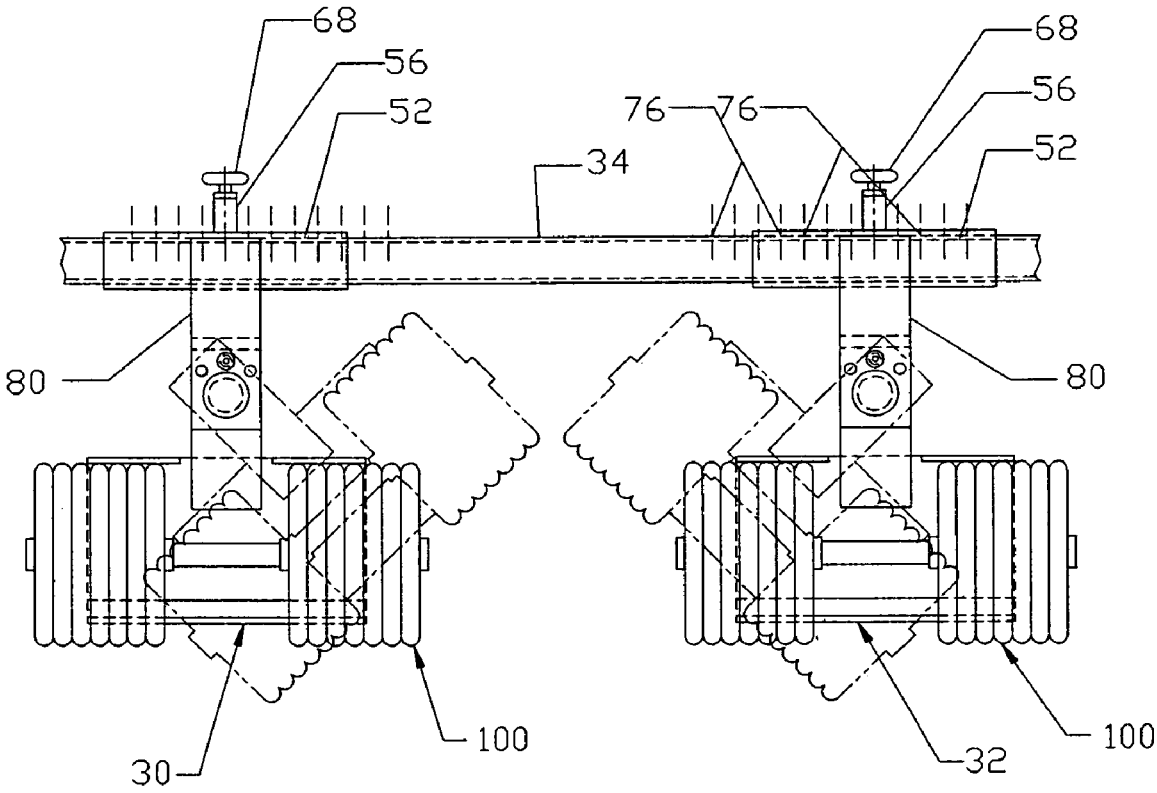
FIG. 4 is an enlarged, partial, plan view showing the pivotal and horizontally adjustable dumbbell supports depicted in FIGS. 1–3.

As shown in FIG. 4, a plurality of spaced apertures 76 are formed in the horizontal crossbar 34. The apertures 76 may be laterally spaced along the entire length of the crossbar 34 or located only at the outer ends over which the mounting collars 52 of the dumbbell supports 30 and 32 are movably disposed.

In this manner, outward movement of the pin 62 will enable the mounting collar 52 of one of the dumbbell supports 30 and 32 to be horizontally adjusted along the crossbar 34 to another position selected by the user. Release of the knob 68 will cause the pin 62 to move through the aperture 74 in the collar 52 and an aligned aperture 76 in the crossbar 34 to again latch the moved dumbbell support 30 or 32 in a new position on the crossbar 34.

The above described dumbbell support latch will be understood to be about way of example only as other latch mechanisms may also be employed, such as a simple set screw extending through the mounting collar 52 into fixed, but releasable engagement with the crossbar 34.

A plate 80 is fixedly mounted to the collar 52 and projects therefrom. The other end of the plate 80 has a bore 81 which receives a tubular member 82. By example only, the plate 80 may be fixedly joined to the mounting collar 52 by welds. The tubular member 82 is fixedly joined to a disc or handle 86 disposed extendably of one end of the tubular member 82. The disc 86 rotatably holds the tubular member 82 within the bore 81. An intermediate portion of the tubular member 82 is fixedly joined to an arm 90, such as by welds. The arm 90 is rotatably movable relative to the plate 80, and the mounting collar 52, in a cutout 91 in the plate 80.

The arm 90 has a cutout which receives a base plate 92 and a rear plate 93 which act as a dumbbell rest for supporting a dumbbell 100 on the arm 90. A lip 95 may be mounted on a forward end of the base plate 92 to retain the dumbbell 100 on the base plate 92.

A centrally located notch 94 extends inward from an outer end of the arm 90 and defines a gripping area which enables a weightlifter to easily extend his or her hand through the notch 94 to grip the dumbbell handle when the dumbbell 100, is disposed on a arm 90. By example only, the handle 102 of the dumbbell 100 extends laterally across the notch 94 with the dumbbell weights 104 and 106 disposed on opposed ends, of the arm 90.

The arm, 90 is suited for receiving hex-shaped dumbbell weights. For circular weights, the arm 90 may have arcuate shape or be provided with a front lip and a back wall to non-movably receive the circular dumbbell weights.

As shown in FIGS. 4, 6, and 7, a plurality of apertures, such as first, second, and third apertures 112, 114, and 116, respectively, are formed in one end of the arm 90. The apertures 112, 114, and 116 are sized to removably receive a latch pin 118 which is releasibly extendable through a bore 120 in the tubular member 80. The mounting pin 118 generally includes a shaft portion 124 and a handle in the form of a ring or eyelet 126 to facilitate easy gripping.

In use, the mounting collars 52 of each dumbbell support 30 and 32 will initially be mounted over the horizontal crossbar 34 before opposed ends of the crossbar 34 are fixed to the collars 49. The horizontal or lateral spacing between the dumbbell supports 30 and 32 can be adjusted by pulling the knob 68 on one or both the dumbbell supports 30 and 32 away from the respective mounting collar 52 until the pin 62 releases from one aperture 76 in the crossbar 34. The user can then laterally shift the position of the dumbbell support 30 or 32 along the crossbar 34 until the desired lateral spacing between the dumbbell supports 30 and 32 is achieved. The knob 68 is then released allowing the pin 62 to re-engage a different aperture 76 in the crossbar 34 to lock the dumbbell support 30 or 32 in a new position on the crossbar 34.

It should be noted that the lateral space between the dumbbell supports 30 and 32 may be adjusted to suit the size of a user as well as to adapt the support for use in performing different weightlifting exercises.

It will be understood that more or less apertures 112, 114 and 116 can be formed on the arm 90 to provide different degrees of incremental spacing between pivotal positions of the dumbbell rest 30 and 32 relative to the crossbar 34. In the angular arrangement of the three apertures 112, 114, and 116 on the arm 90 shown in FIGS. 4 and 7, the aperture 112 represents a generally perpendicular position of each dumbbell support 30 and 32 relative to the horizontal crossbar 34. This leaves the apertures 114 and 116, when pivoted underneath and engaged with the pin 124, to define angular positions in which the dumbbell supports 30 and 32 are disposed at a non-perpendicular or acute angle relative to a central portion of the crossbar 34 as shown in FIGS. 4 and 7. This facilitates a more easy and natural gripping of the handles 102 of the dumbbells 100 for certain weightlifting exercises. In addition, the weightlifter can grasp each dumbbell handle 102 in an overhand grip before lifting the dumbbells 100 from the dumbbell supports 30 and 32 and elevating his or her arms upward while moving the dumbbells 100 until the weightlifter achieves an underhand grip used for biceps curl exercises.

This pivotal repositioning of each dumbbell support 30 and 32 with respect to the horizontal crossbar, when coupled with the easy horizontal repositioning of each dumbbell support 30 and 32 along the crossbar 34, makes the performance of a number different dumbbell exercises much more simple. More importantly, the dumbbells 100 are continually supported on the dumbbell supports 30 and 32 and do not have to be picked up off the floor thereby minimizing the potential of back injury to a weightlifter, particularly at high dumbbell weight levels.

The following table describes the various exercises along with the hand grip orientation, the position of the user and the position of the dumbbell supports 30 and 32. As is readily seen from this table, the present invention provides the user with the ability to perform a wide range of different exercises in a variety of positions.

| EXERCISES | | | |
|---|---|---|---|
| Exercise Type | Hand Grip | Position | Dumbbell rest position |
| shoulder press | underhand | seated | angled |
| shoulder press | underhand | standing | straight |
| bench press (flat, inclined, or decline) | overhand | lying on bench | straight |
| incline press | underhand | seated | angled |
| biceps curls | underhand | standing | straight |
| flys | overhand | lying on bench | straight |

Figure 8:
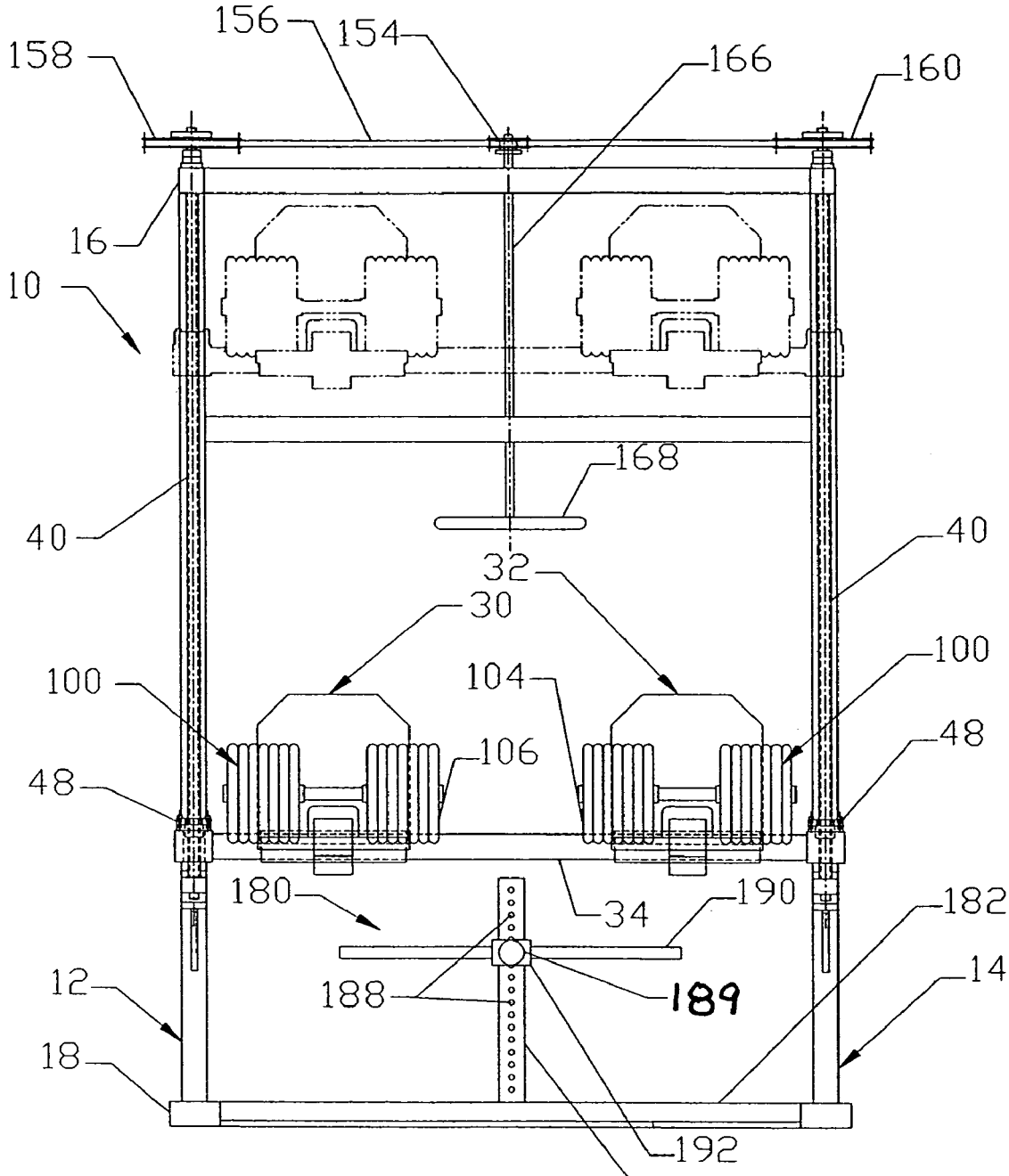
FIG. 8 is a front elevational view of another aspect of a dumbbell support apparatus according to the present invention.
Figure 9:
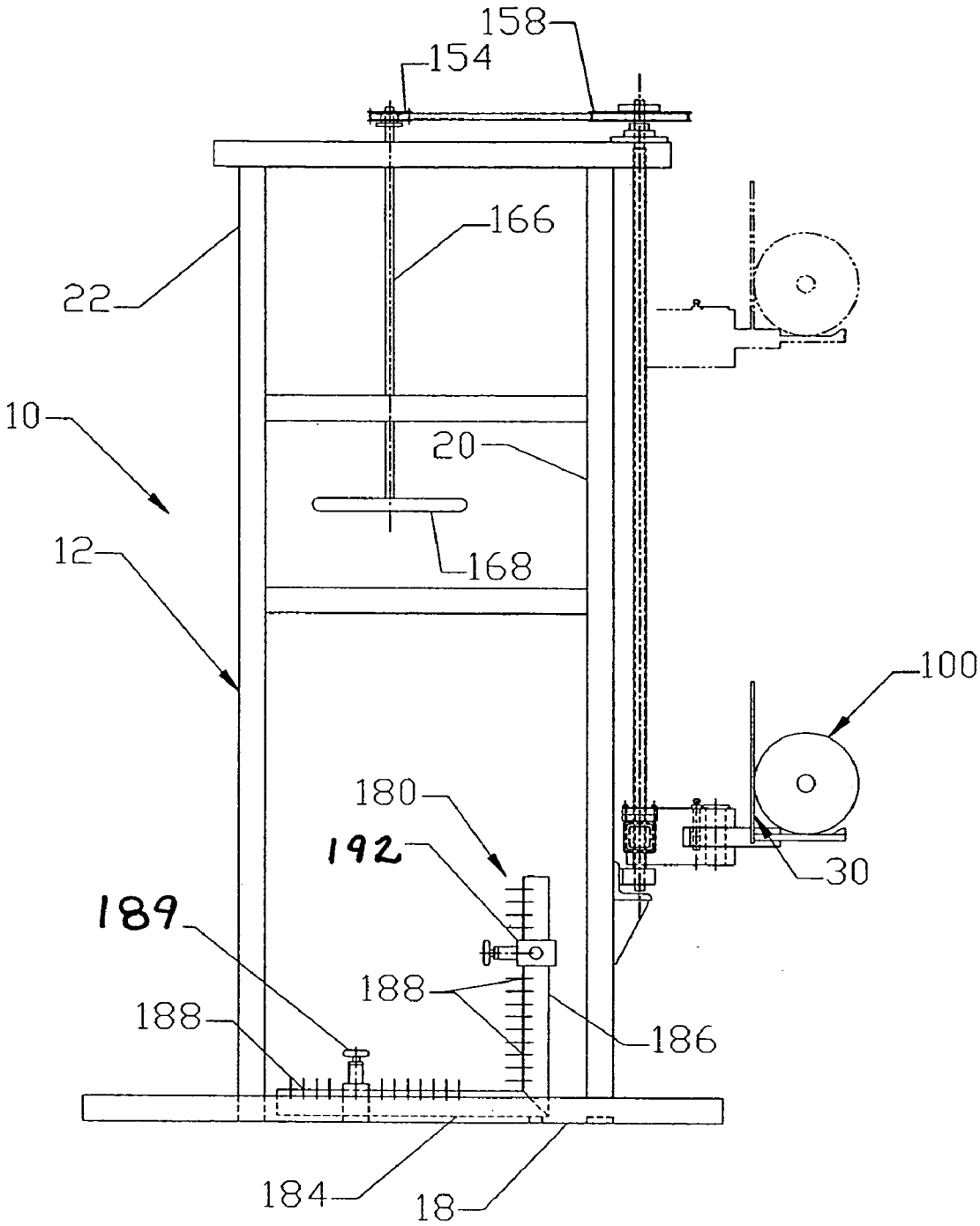
FIG. 9 is a side elevational view of the dumbbell support apparatus shown in FIG. 8.
Figure 10:
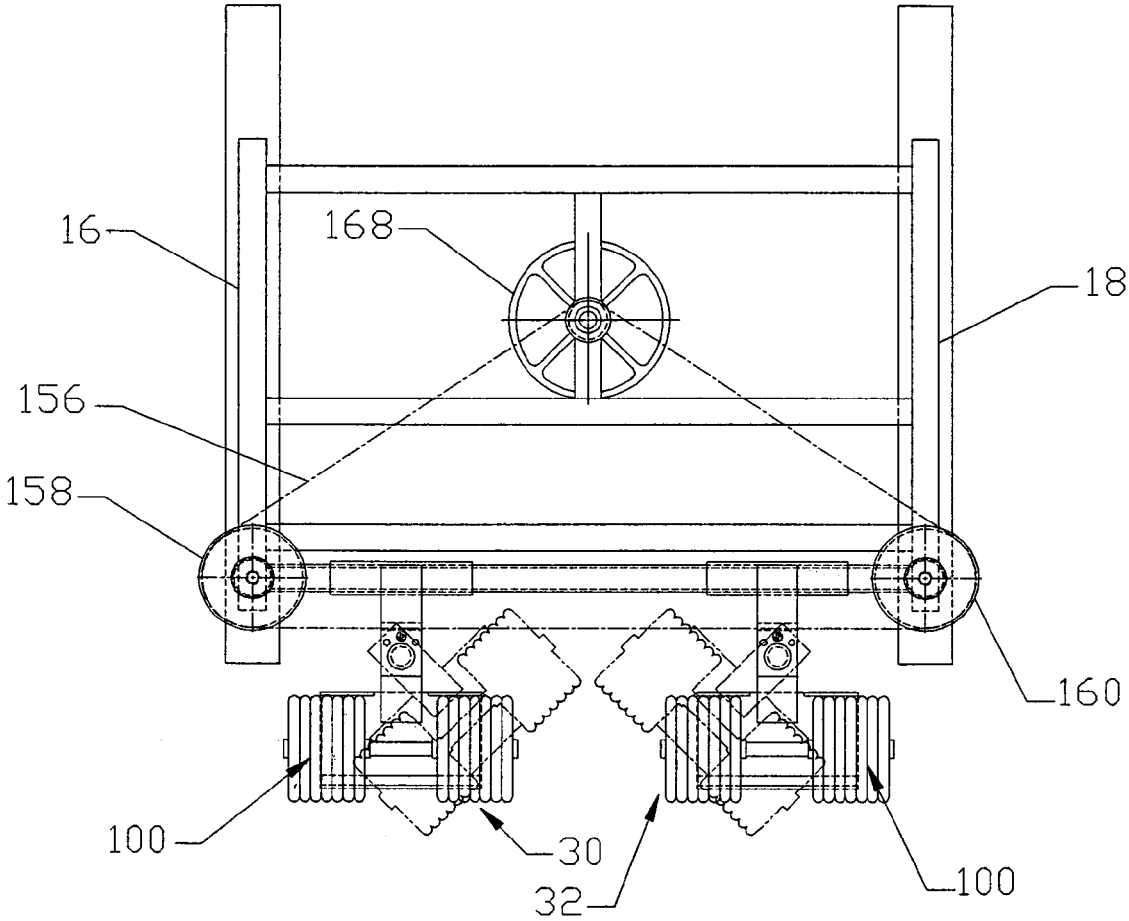
FIG. 10 is a plan view of the dumbbell support apparatus shown in FIGS. 8 and 9.

Referring now to FIGS. 9 and 10, there is depicted yet another aspect of a dumbbell support according to the present invention. This aspect of the invention is substantially the same as the motor driven aspect described above and shown in FIGS. 1–3 and so far as including the identical support frame, horizontal crossbar 34, dumbbell supports 30 and 32, threaded screws 40 and pulleys 154, 158 and 160. However, in this aspect, the motor 46 is replaced by a manually rotatable shaft 166 which is fixedly coupled to the drive pulley 154. A handle or crank 168 is fixed one end of the shaft 166 and is located at a convenient location within the support frame, as shown in FIGS. 8, 9 and 10, to facilitate easy access and rotation of the shaft 166.

Upon rotation of the shaft 166 in either direction, the rotation force is transmitted from the pulley 154 by the elongated member or timing belt 156 to the pulleys 158 and 160 which are coupled to the threaded screws 40. The operation of the screws 40 and the cooperating nuts 48 carried on the ends of the crossbar 34 is identical to that described above and shown in FIGS. 1–3. As such, the operation of the dumbbell support apparatus shown in FIGS. 8–10 will not be described in further detail.

Yet another aspect of the present invention can be seen in FIGS. 1, 2, 8, and 9. In this aspect, a foot support 180 is disposed between the side frames 12 and 14 along a generally vertical center line of the entire support frame 10. The foot support 180 may be a completely separate element non-attached to the support frame 10 or an integral part of the support frame 10 wherein the foot support 180 is fixedly and/or releasably fixed to the support frame 10 by means of welds, fasteners, etc.

The foot support 180 includes the horizontally extending tubular base 182 which extends laterally between the side frames 12 and 14. A transverse leg 184 projects rearwardly from one end of a front leg 186 mounted on the base 182. The rearward leg 184 and the front leg 186 each include a plurality of apertures 188 which receive a spring biased pin, similar to the retractable latch pin 62 shown in FIGS. 6 and 7. Retractable latch assemblies 189 are mounted to the legs 184 and 186 and are slidable along the rearward extending leg 184 and the front leg 186 to allow fore and aft as well as vertical adjustment of a foot rest or bar 190. The bar 190 is fixedly carried within a sleeve 192 movable vertically along the front leg 186. The foot support 180 is usable in seated exercises for additional support.

In summary, there has been disclosed a unique dumbbell support apparatus which facilitates the performance of dumbbell weightlifting exercises while providing a high degree of safety to the weightlifter during the performance of the exercise as well as minimizing the possibility of injury during rearrangement of the dumbbell weights.

What is claimed is:

1. A weightlifting apparatus for supporting a dumbbell, the apparatus comprising:

first and second side frames;

an elevation adjustment mechanism carried on the first and second side frames;

a cross-support mechanism having collars at opposite ends of the cross-support mechanism, and the collars being coupled to the elevation adjustment mechanism, the cross-support mechanism being comprised of a horizontal crossbar;

a crossbar mounting portion for movably adjusting the dumbbell support along the crossbar;

means for latching the crossbar mounting portion to the crossbar in a plurality of discrete positions; and at least one dumbbell support coupled to the cross-support mechanism for supporting a dumbbell in a plurality of different elevations and lateral positions, the dumbbell support mounted on the crossbar.

2. The weightlifting apparatus of claim 1, wherein the dumbbell support comprises:

an angularly adjustable, pivotal portion adapted for receiving and supporting a dumbbell.

3. The weightlifting apparatus of claim 2, wherein the angular adjustable, pivotal portion includes a dumbbell receiver for supporting the dumbbell.

4. The weightlifting apparatus of claim 3, further comprising:

a notch formed in the dumbbell receiver to facilitate access to the dumbbell mounted on the angularly adjustable, pivotal portion.

5. The weightlifting apparatus of claim 3, wherein the dumbbell receiver comprises:

a plate pivotally coupled to the cross-support mechanism, the plate including a plurality of spaced apertures; and a latch carried on the cross-support mechanism and releasably engagable with one of the apertures to adjust the angular position of the plate with respect to the cross-support mechanism.

6. The weightlifting apparatus of claim 1, further comprising:

means for latching the crossbar mounting portion to the crossbar in one of a plurality of positions along the crossbar.

7. The weightlifting apparatus of claim 1, wherein the latching means comprises:

a plurality of spaced apertures along the crossbar; and a spring biased pin carried on the crossbar mounting portion releasably engagable with one of the apertures in the crossbar.

8. The weightlifting apparatus of claim 1, wherein the dumbbell support comprises two dumbbell supports.

9. A weightlifting apparatus for supporting a dumbbell, the apparatus comprising:

first and second side frames;

an elevation adjustment mechanism carried on the first and second side frames;

a cross-support mechanism having collars at opposite ends of the cross-support mechanism, and the collars being coupled to the elevation adjustment mechanism;

at least one dumbbell support coupled to the cross-support mechanism for supporting a dumbbell in a plurality of different elevations and lateral positions;

the elevation adjustment mechanism comprises:

a threaded screw supported on each of the first and second side frames;

a rotative drive coupled to both screws for bi-directionally rotating both screws; and the cross-support mechanism coupled to each of the screws for elevational movement.

10. The weightlifting apparatus of claim 9, further comprising:

a horizontal crossbar movably coupled to each screw, the dumbbell support carried on the crossbar.

11. The weightlifting apparatus of claim 9, wherein the drive comprises:

an electric motor mounted to the first and second side frames, the motor the electric motor having an output shaft; and an elongated member extending to and coupled to each screw and to the output shaft for transmitting rotation of the motor output shaft to each of the screws.

12. The weightlifting apparatus of claim 9 wherein the rotative drive comprises:

a first rotatable member;

second and third rotatable members each fixedly coupled to one of the screws; and an elongated member extending to and coupled to each of the first, second and third rotatable members for transmitting rotation of the drive to each of the screws.

13. The weightlifting apparatus of claim 12, wherein:

the first, second and third rotatable members include teeth; and the elongated member includes teeth meshingly engagable with the teeth on the first, second and third rotatable members.

14. The weightlifting apparatus of claim 12, wherein the drive comprises:

a rotatable shaft coupled to the first rotatable member such that rotation of the shaft rotates the first rotatable member.

15. A weightlifting apparatus for supporting a dumbbell, the apparatus comprising:

first and second side frames;

a horizontal crossbar extending between the first and second side frames;

a cross bar support mechanism operatively connected to said crossbar and providing elevational adjustment for the cross bar relative to the first and second side frames;

a pair of dumbbell supports movably mounted on the crossbar; and a latch on each dumbbell support for releasably latching each dumbbell support in a horizontally adjustable position along the crossbar.

16. The weightlifting apparatus of claim 15, wherein the latch comprises:

a plurality of spaced apertures formed along the crossbar; and a latch pin carried on the each dumbbell support, the pin releasably engagable with one of the apertures in the crossbar to releasably latch the dumbbell support in a selected horizontally adjustable position along the crossbar.

17. The weightlifting apparatus of claim 16, further comprising:

a crossbar mounting portion carried on each dumbbell support and movable along the crossbar;

an angularly adjustable, pivotal portion coupled to the crossbar mounting portion, for receiving and supporting a dumbbell;

a dumbbell receiver carried on the pivotal portion; and means for locking the dumbbell receiver in one of a plurality of angular positions with respect to the crossbar mounting portion.

18. A weightlifting apparatus for supporting a dumbbell, the apparatus comprising:

first and second side frames;

a horizontal crossbar extending between the first and second side frames;

a pair of dumbbell supports movably mounted on the crossbar;

a crossbar mounting portion carried on each dumbbell support and movable along the crossbar;

an angularly adjustable, pivotal portion coupled to the crossbar mounting portion, for receiving and supporting a dumbbell;

a dumbbell receiver carried on the pivotal portion; and means for locking the dumbbell receiver in one of a plurality of angular positions with respect to the crossbar mounting portion.

19. A weightlifting apparatus for supporting a dumbbell, the apparatus comprising:

first and second side frames;

a crossbar extending horizontally between the first and second side frames;

elevation adjustment means carried on the first and second side frames and coupled to the crossbar for moving and supporting the crossbar in a plurality of different elevations;

at least one dumbbell support coupled to the crossbar for supporting a dumbbell; and a foot rest disposed within the first and second side frames, the foot rest comprising a support frame providing vertical and fore/aft adjustable positioning of a foot support member.

20. A weightlifting apparatus for supporting a dumbbell, the apparatus comprising:

first and second side frames;

a horizontal cross-support mechanism extending between the first and second side frames;

a cross bar support mechanism operatively connected to said crossbar and providing vertical adjustment for the cross bar relative to the first and second side frames; and a pair of dumbbell supports laterally movably mounted on the cross-support mechanism, the dumbbell supports being profiled as platforms, allowing a user to grasp a handle of the dumbbell for lifting.

21. The weightlifting apparatus of claim 20, further comprising a positioning mechanism to define a laterally adjustable position along the cross-support mechanism.

22. The weightlifting apparatus of claim 21, wherein the positioning mechanism is comprised of a latch.

23. The weightlifting apparatus of claim 22, wherein the latch comprises:

a plurality of spaced apertures formed along the cross-support mechanism; and a latch pin carried on the each dumbbell support, the pin releasably engagable with one of the apertures in the cross-support mechanism to releasably latch the dumbbell support in a selected horizontally adjustable position along the cross-support mechanism.

24. The weightlifting apparatus of claim 23, further comprising:

a cross-support mechanism mounting portion carried on each dumbbell support and movable along the cross-support mechanism.

25. The weightlifting apparatus of claim 24, further comprising:

an angularly adjustable, pivotal portion coupled to the cross-support mechanism mounting portion, for receiving and supporting a dumbbell;

a dumbbell receiver carried on the pivotal portion; and means for locking the dumbbell receiver in one of a plurality of angular positions with respect to the cross-support mechanism mounting portion.

26. The weightlifting apparatus of claim 20 wherein the horizontal cross-support mechanism is comprised of first and second collars movable vertically relative to the first and second side frames, and a cross bar extending between the first and second side collars.

27. A weightlifting apparatus for supporting a dumbbell, the apparatus comprising:

first and second side frames;

a pair of dumbbell supports operatively coupled to the first and second side frames, the dumbbell supports being profiled as platforms, allowing a user to grasp a handle of the dumbbell for lifting, the dumbbell supports being both laterally and vertically movable relative to the first and second side frames; and a horizontal cross-support mechanism extending between the first and second side frames, the cross-support mechanism being vertically movable relative to the first and second side frames, and the pair of dumbbell supports laterally movably mounted on the cross-support mechanism.

28. The weightlifting apparatus of claim 27, further comprising a positioning mechanism to define a laterally adjustable position along the cross-support mechanism.

29. The weightlifting apparatus of claim 27, wherein the horizontal cross-support mechanism is comprised of first and second collars movable vertically on the first and second side frames, and a cross bar extending between the first and second side collars.

* * * * *